US005499031A

United States Patent [19]

Bodonyi

[11] Patent Number: 5,499,031

[45] Date of Patent: Mar. 12, 1996

[54] DISTRIBUTED RECEIVER SYSTEM FOR ANTENNA ARRAY

[75] Inventor: Janos Bodonyi, Bicknacre, United Kingdom

[73] Assignee: The Marconi Company Limited, United Kingdom

[21] Appl. No.: 578,519

[22] Filed: Aug. 14, 1990

[30] Foreign Application Priority Data

Sep. 28, 1989 [GB] United Kingdom ..... 8921917

[51] Int. Cl.[6] ..... G01S 7/40

[52] U.S. Cl. ..... 342/174

[58] Field of Search ..... 342/173, 174, 342/372, 373, 374

[56] References Cited

U.S. PATENT DOCUMENTS 4,060,806 11/1977 Davies et al. ..... 342/174
4,176,354 11/1979 Hsiao et al. ..... 342/174
4,520,361 5/1985 Frazita ..... 342/372
4,949,090 8/1990 Tamii et al. ..... 342/173

FOREIGN PATENT DOCUMENTS

WO8500895 2/1985 WIPO .

*Primary Examiner*—Mark Hellner
*Attorney, Agent, or Firm*—Spencer & Frank

[57] ABSTRACT

In an antenna array of large dimensions, such as might be used for high frequency radar, the antennas 1*a*, 1*b*, will be connected by short feeders 2*a*, 2*b*, to receivers 3*a*, 3*b*, which will consequently be distributed over a considerable distance. Calibration of such an antenna array to compensate for variations in the transfer functions of the receivers will necessitate the same test signal being fed into each element in turn to measure the receiver output, and this could be time consuming and hence reduce the time available for use of the array. To overcome this disadvantage, a loop 5 is connected at various tappings to the feeders 2*a*, 2*b*, the respective antennas are disconnected, and sinusoidal tones are injected into the left hand and right hand ends of the loop. The outputs of the receivers are measured, and provide a measure of the transfer functions of the receivers and hence enables discrepancies between them to be corrected.

8 Claims, 1 Drawing Sheet

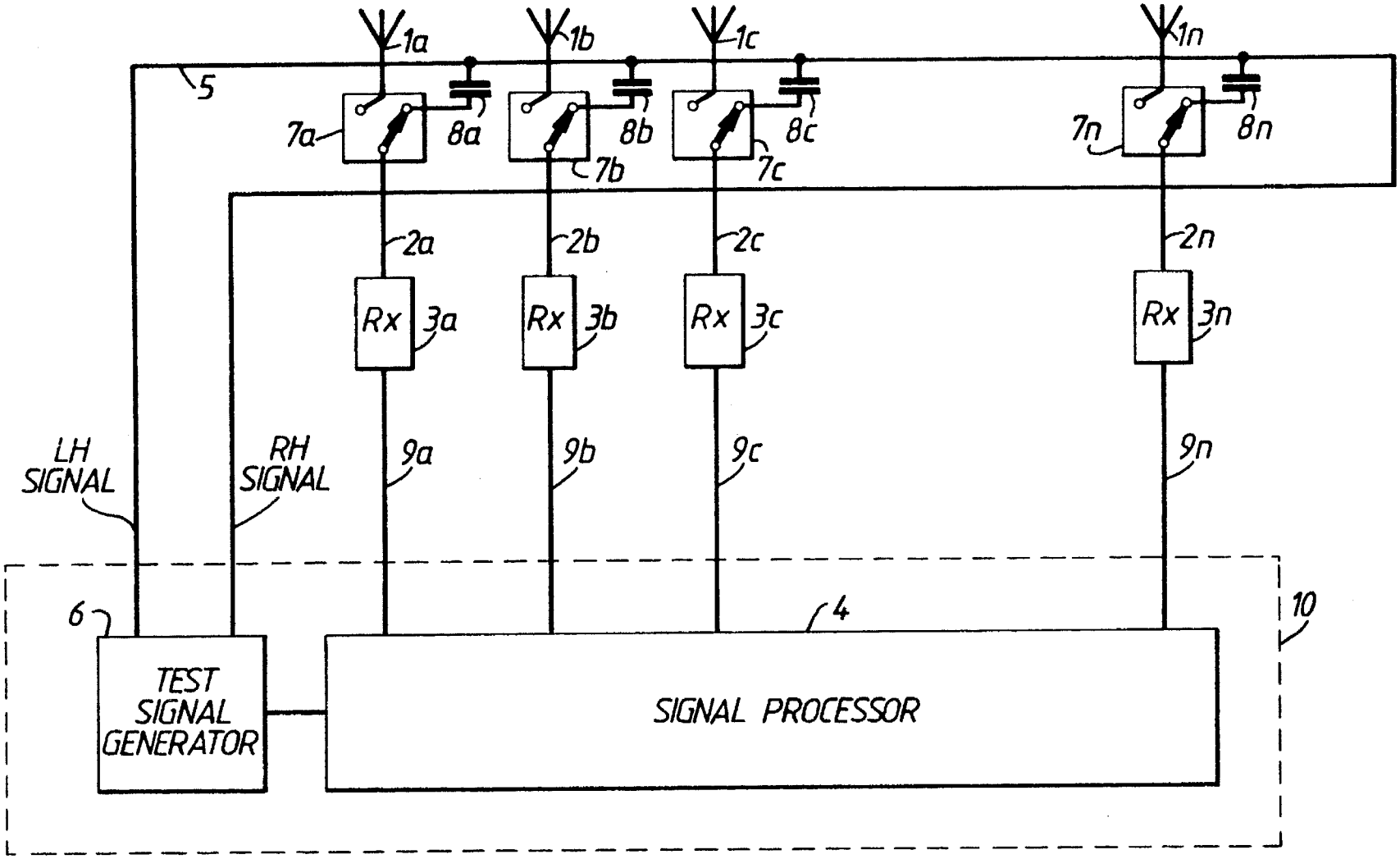
1a
1b
1c
1n
7a
7b
7c
7n
8a
8b
8c
8n
2a
2b
2c
2n
Rx
3a
3b
3c
3n
9a
9b
9c
9n
10
4
SIGNAL PROCESSOR
RH SIGNAL
LH SIGNAL
5
6
TEST SIGNAL GENERATOR

DISTRIBUTED RECEIVER SYSTEM FOR ANTENNA ARRAY

BACKGROUND OF THE INVENTION

This invention relates to distributed receiver systems associated with antenna arrays and especially to the calibration of such receiver systems.

Arrays of antennas are used when it is desired to detect small signal strength, for example, in the case of a high frequency (approximately between 3 MHz and 30 MHz) radar installation. Receiving antenna arrays which could be suitable for detecting surface or sky wave might have many antenna elements spaced apart to form a long antenna aperture (typically between tens of meters to several thousand meters).

From signals appearing at the antenna terminals narrow receiving beams are formed, usually by means of digital computation, after the weak antenna signals are amplified by frequency selective receiving equipment then sampled and converted into digital signals. The advantages of digital beamforming are maximised when one receiving antenna element is feeding one and only one receiver, i.e., each receiver is dedicated to a specific antenna element.

Cables connecting the antenna elements to the receivers (or to pre-amplifiers if they are physically separated from the receivers) are usually made physically short in order to minimise signal loss due to cable attenuation. Therefore, the installed receiving system (that is the collection of receiving apparatus and associated supporting peripherals such as local oscillators, timing units, frequency and timing distributors, pre-amplifiers, signal pre-processors, interfaces etc.) will become distributed along the physical aperture of the antenna array. The receiving equipment on the receiving site might be evenly distributed or clustered in more than one shelter.

Beamforming techniques by digital computation are well known from the technical literature. Most beamforming computation in essence involves the multiplication of the digitised signal samples from each of the receiver outputs with the beam coefficients followed by summing these products for corresponding signal samples. One set of beam coefficients is specific to a given beam pointing direction and as many sets are required as number of beams to be formed.

The theoretical values of beam coefficients assume equal signal transfer between antenna terminals and associated receiver outputs for all the elements in the receiving array. Should the actual receivers differ in their transfer functions then the beam coefficients must be corrected by calibration factors, so that the resultant beam(s) will satisfy the beamwidth and sidelobe level requirements.

Practical receivers made to some manufacturing tolerances may differ in their initial electrical characteristics and are subject to further variation in use. When integrated into a system, changes can take place in the receiver itself and/or in the auxiliary input signals to the receiver. For example, fixed and variable local oscillator frequencies (generated centrally in the system and distributed to the receiver mixers) might change in amplitude and phase and cause a corresponding effect in the received signal. Furthermore, changes in the power supply and in the ambient temperature will have indirect effects on the signal.

The time dependent changes in a receiver's transfer characteristic is observable in a slow random variation in amplitude, phase and group delay of the output signal. For example, if the same signal was applied to the inputs of all receivers in a distributed system then, at a given time, the output signal's amplitude and phase would be unlikely to remain identical but, instead, be distributed randomly between the receivers with a finite variation. The apparent random distribution can be expected to change with time to other random distributions.

The objective of a calibration procedure is to determine the receiver's transfer characteristics for the signal components of the used waveform. Waveforms, in general, can be viewed as being composed from a collection of sinusoidal waves each of which is described by a complex number with parameters of amplitude and phase at a given frequency.

Calibration should be carried out for less than or equal to that time interval which corresponds to just tolerable errors in the formed beams resulting from waveform component variations in the receiver system over that interval. In order to maximise operation time, the calibration procedure must be rapid and efficient.

For example, one possible calibration procedure for the receiving system would involve the disconnection of the receiver cables from the antenna elements and feeding test signals into the receiver inputs. Measurements of the output signal could be carried out one by one for each receiver in order to obtain a set of calibration data. While such a consecutive method would be adequate for installations with small number of receivers, for a large aperture distributed system the calibration time requirement would reduce prohibitivety the system availability for operation.

Concurrent measurements would require a distribution network for delivering the test signal to receivers which might be spaced out over several thousand meters. Such a network must ensure that the test signals at all receiver input terminal are identical in both amplitude and phase at any frequency. Clearly the test signal distribution network (purely passive or possibly containing active components) will require initial setting up and periodic calibration, as its components, similarly to the main receiver system, are subject to time dependent variation. Calibration of such large scale distribution network would create problems that are comparable with the receiving system calibration.

SUMMARY OF THE INVENTION

The invention provides apparatus for calibrating receivers for an antenna array, each antenna of the array being coupled to a respective receiver, the calibration apparatus comprising means for selectively disconnecting each receiver from the corresponding antenna and for connecting that receiver to a respective tapping of a loop, and means for feeding an rf signal along the loop in each direction in turn and for detecting the resulting amplitude and phase at each receiver in each case.

The invention also provides a method of calibrating receivers for an antenna array, each antenna of the array being coupled to a respective receiver, the calibration comprising selectively disconnecting each receiver from the corresponding antenna and connecting that receiver to a respective tapping of a loop, and feeding an rf signal along the loop in each direction in turn and detecting the resulting amplitude and phase of each receiver in each case.

This invention provides an apparatus and method for calibrating a large distributed receiver system and enables the errors normally encountered in calibrating systems with large distances between input terminal to be cancelled.

Apparatus for and a method of calibrating receivers for an antenna array in accordance with the invention will be described below by way of example with reference to the accompanying drawing.

BRIEF DESCRIPTION OF THE DRAWING

The Figure is a block circuit diagram of the apparatus according to the invention.

DETAILED DESCRIPTION OF THE PREFERRED EMBODIMENTS

Antennas 1*a*, 1*b*, 1*c*, etc form a receive antenna array for high frequency radar signals. The antennas are each vertically orientated and are spaced apart in row. The antenna array may be suitable for receiving over-the-horizon radar signals from ground waves or, for longer distances, from sky waves.

Each antenna 1*a*, 1*b* etc is connected by a short coaxial feeder cable 2*a*, 2*b*, etc to a receiver 3*a*, 3*b*, etc arranged near to the respective antenna. The outputs of the receivers (which may be analogue or pre-processed digital signals) are connected by cables or optical fibre data links 9*a*, 9*b* etc to a single signal processor 4 arranged at a suitable location 10.

In accordance with the invention, there is provided a coaxial cable 5, having a length that is at least twice the antenna array aperture, which is installed along the full length of the antenna array such that it forms a loop when its two ends are brought into close proximity. The characteristic impedance of the cable and its uniformity are not important.

At each point where the cable 5 passes the feed point of an antenna, the cable is equipped with a tapping device suitable for coupling out a small amount of power from the cable. The coupling coefficients for every tapping point are equal and non directional, i.e., the same coupled power will be measurable when the power in the coaxial cable is travelling in the left or right hand directions.

A changeover switch 7*a*, 7*b* etc is installed at each antenna feed point and is suitable for disconnecting the antenna feed point from its associated receiver cable 2*a*, 2*b* etc and for re-connecting it to the corresponding coupling point of the calibration loop 5 via a respective blocking capacitor 8*a*, 8*b* etc. (Any electromagnetic coupling device (such as a voltage or current probe) without directional property, such as an inductor, resistor may be used in place of the capacitors.) All switches have common control so that the above-mentioned change-over action for calibration takes place simultaneously in all receiver inputs.

A test signal generator 6 is provided with at least a sinusoidal output signal, but may also be capable of providing any arbitrary waveform. The generator 6 can be controlled in amplitude, is tunable to any desired carrier frequency and is suitable for feeding alternatively the output signal into either end of the calibration cable loop. The unexcited end of the cable must be terminated by a suitable resistive load that matches the cable.

The processor 4 includes a timing generator to provide reference timing pulses for the test signal generator and for the receivers. The timing generator and associated timing pulse distribution network is formed by existing parts of the receiving system.

The processor 4 includes means suitable for concurrently measuring the output and also suitable for presenting the measured results of each component of the test signal numerically (in complex number format) to a computer in the signal processor intended to carry out the necessary computation for calibration.

If a sinusoidal signal, denoted by S, is sent in one direction (left to right) along the calibration cable, at any particular tapping, signal A is obtained. If the same signal S travels in the opposite direction (right to left) along the same cable, signal B is obtained at the same tapping. It can be shown that the product, C= A.B is equal to a constant= S.S.Hc where Hc is the transfer coefficient of the calibration cable between its two end points at the frequency of signal S. In other words, whatever the tapping point, the product of the signals received is a constant. The calibration method relies on this fact and enables the same effect to be achieved as if an identical signal was fed to each feeder cable, which is necessary for calibration of the individual receivers and their associated feeder cables.

That the relation described in the previous paragraph is correct can be understood intuitively in the following way. If a signal is injected into the left hand end of the section of the loop that is connected to the antennas the signal will be more attenuated by the time it reaches the last antenna on the right than it was when it reached the first antenna on the left hand side. However, an identical tone injected into the right hand end of the loop will be more attenuated by the time it reaches the first antenna of the row on the left hand side than when it reaches the last antenna of the row on the right hand side. It can also be seen that the phase (which has equal or greater importance in calibration than the amplitude alone) will remain invariant at all the tapping points of the calibration cable when the products of the left and right hand signals are formed. Considering that the phase lag of the left hand signal is proportional to the path length of that part of the cable at the left of a given tapping point. Similarly the phase lag of the right hand signal is proportional to the path length of the right hand portion of the cable. Since the phase of the product is the sum of phases (of the left and right hand signals), this will always be proportional to the whole path length of the calibration cable, hence the product phase will remain the same at any tapping point.

The transfer coefficient of a receiver is the ratio of two complex numbers describing one sinusoidal signal at the input of the receiver and a corresponding signal at the output of the receiver. Note that a receiver function includes frequency translation, therefore the frequency of the signal at the input and at the output might be different. The transfer function of a receiver is the collection of transfer coefficients for all input frequencies which are the components of the used waveform. If a receiver was constructed so that its dominant frequency selective filter is inherently phase linear (such as finite impulse response digital filter) then it can be characterised sufficiently by a single transfer coefficient in the band centre and by the group delay time (which is equal to the phase change per unit frequency).

In operation of the calibration procedure, all receiving cables 2*a*, 2*b* etc are disconnected from the feed points of all antenna elements 1*a*, 1*b* etc and are connected to the corresponding tapping points of the calibration cable 5 by means of the changeover switches 7*a*, 7*b* etc.

In response to a timing trigger pulse from the timing pulse generator in the processor 4, a desired waveform is applied into one then the other end of the calibration cable from the test signal generator 6. The unexcited end of the cable must be terminated by suitable resistive load that matches the cable. The tones may be pulses e.g. of 13 milliseconds duration of unmodulated i.e. pure sine waves. The frequency of operation of the antenna may be in a high frequency region i.e. 3–30 MHz.

A timing trigger pulse is also generated for receivers and be distributed among them by the distributor network.

The timing trigger pulse is to designate the start or the first point of the series of transmitted and received signal samples. For a given receiver, the exact arrival time of the trigger pulse is not critical and its delay may be adjusted so that the first data sample is taken shortly after the arrival of the test signal at a referencing point in the receiver. Once adjusted, the relative time separation between the trigger pulses for the test signal generator and for the receivers must be kept fixed for the duration of the left and right hand test signals, and this relation between starting pulses, must be extended to the operation period following a given calibration session.

At all receiver outputs, measurements are taken concurrently and the results are stored to compute the calibration coefficient for each receiver. For a given receiver two complex numbers will correspond to the measured left and right hand signal for each component frequency of the test waveform. It can be shown that the product of these pair of complex numbers are $$S.S.Hc.Hk.Hk$$

where the meaning of S and Hc are given above and Hk is the transfer coefficient (equal to the calibration coefficient) of the receiver in question. The lower case k denotes the k-th receiver..

If S and Hc are known then Hk can be computed from the above expression. In most practical cases it is sufficient to know the calibration coefficients relative to one reference i.e. to a selected reference receiver. In this case the values of S and Hc are not important as they are the common factor in all the left and right hand output signal products (computed as described above) and will cancel out when ratios are taken.

In principle, the test waveform can be selected arbitrarily or be the same as used for operation. The first step of the computation, in this case, is to analyse the signal into sinusoidal components by well known algorithms of Fourier transformation, then the calibration factors can be computed for each of the components.

When the transfer coefficients for each frequency component for each receiver have been calculated for each receiver, the signal processor uses these values for compensating the beam forming coefficients used with signals received via the antennas in use. The outputs are multiplied by the compensated beam coefficients and summed to produce desired narrow receiving beams.

The calibration may be carried out as a once for all operation, but it is preferable that it is carried out periodically, for example, at intervals of about one hour.

I claim:

1. Apparatus for calibrating receivers for an antenna array, each antenna of the array being coupled to a respective receiver, the calibration apparatus comprising means for selectively disconnecting each receiver from the corresponding antenna and for connecting that receiver to a respective tapping of a loop, and means for feeding an rf signal along the loop in each direction in turn and for detecting the resulting amplitude and phase of said rf signal at each receiver in each case.

2. Calibration apparatus as claimed in claim 1, in which the disconnecting means is arranged to disconnect each antenna from its receiver cable, and to connect the respective tapping to the receiver cable.

3. Calibration apparatus as claimed in claim 2, in which the processing means is arranged to apply a correction signal in accordance with the detected calibration signals.

4. Calibration apparatus as claimed in 3, in which the processing means is arranged to apply correction signals to beam forming coefficients with which the receiver outputs are multiplied in use to generate formed beams.

5. Calibration apparatus as claimed in claim 1, in which in use the signal is a burst of unmodulated sinusoidal wave.

6. An antenna array in combination with receivers calibrated using apparatus of the form defined in claim 1.

7. A method of calibrating receivers for an antenna array, each antenna at the array being coupled to a respective receiver, the calibration comprising selectively disconnecting each receiver from the corresponding antenna and connecting that receiver to a respective tapping of a loop, and feeding an rf signal along the loop in each direction in turn and detecting the resulting amplitude and phase of said rf signal at each receiver in each case.

8. Apparatus as defined in claim 1 wherein said loop is a coaxial cable having a length which is at least twice that of the aperture of the antenna array and extending along the entire length of the antenna array.

* * * * *